US007797838B2

(12) United States Patent
Chu

(10) Patent No.: US 7,797,838 B2
(45) Date of Patent: Sep. 21, 2010

(54) RETRACTABLE BLADE KNIFE WITH OPENING ASSISTED MECHANISM

(75) Inventor: Chun-Yu Chu, Taipei Hsien (TW)

(73) Assignee: Taylor Brands, LLC, Kingsport, TN (US)

( * ) Notice: Subject to any disclaimer, the term of this patent is extended or adjusted under 35 U.S.C. 154(b) by 420 days.

(21) Appl. No.: 12/050,880

(22) Filed: Mar. 18, 2008

(65) Prior Publication Data

US 2009/0235534 A1 Sep. 24, 2009

(51) Int. Cl.
*B26B 3/06* (2006.01)

(52) U.S. Cl. ..... 30/162; 30/151; 30/338; 30/339

(58) Field of Classification Search ..... 30/162–164, 30/329, 335, 339, 336, 337, 151, 153, 338; 606/167, 182
See application file for complete search history.

(56) References Cited

U.S. PATENT DOCUMENTS 2,854,745 A * 10/1958 Braverman ..... 30/162
4,523,379 A * 6/1985 Osterhout et al. ..... 30/151
5,371,948 A * 12/1994 Liffiton ..... 30/163
5,511,311 A * 4/1996 Collins ..... 30/162
6,148,520 A * 11/2000 Berns ..... 30/2
6,516,520 B1 * 2/2003 Liao ..... 30/162
7,086,158 B1 * 8/2006 Halpern et al. ..... 30/162
7,305,769 B2 * 12/2007 McHenry et al. ..... 30/162
7,540,092 B2 * 6/2009 Polei ..... 30/162
7,574,804 B2 * 8/2009 Bezold et al. ..... 30/162
7,621,051 B2 * 11/2009 Ping ..... 30/162
7,647,702 B2 * 1/2010 Polei ..... 30/162
7,698,821 B2 * 4/2010 Ralph ..... 30/160

* cited by examiner

*Primary Examiner*—Boyer D Ashley
*Assistant Examiner*—Omar Flores-Sánchez
(74) *Attorney, Agent, or Firm*—Luedeka, Neely & Graham, PC

(57) ABSTRACT

A retractable blade knife with an opening assisted mechanism has a handle, a blade mounted in the handle, an extending assembly mounted between the blade and the handle. At least one detent formed at a spine edge of the blade. The extending assembly has a positioning frame, a slider mounted beside the positioning frame and attached to the blade and a spring attached to the positioning frame and the slider. The positioning frame has a resilient rod selectively abutting the spine edge and a proximal end of the blade. The blade should be pushed manually a certain distance to allow the spine edge of the blade to push a rear end of the resilient rod outwardly. When the detent of the blade and a lock protrusion of the slider both depart from the resilient rod of the positioning frame, the spring may further pull the slider to move together with the blade to stretch out the blade. Thus, the spring helps the blade to be extended quickly and the extending assembly also prevents the blade from being retracted or extended accidentally. Therefore, the retractable blade knife with an opening assisted mechanism is used safely and conveniently.

16 Claims, 12 Drawing Sheets

RETRACTABLE BLADE KNIFE WITH OPENING ASSISTED MECHANISM

BACKGROUND OF THE INVENTION

1. Field of the Invention

The present invention relates to a retractable blade knife, especially to a retractable blade knife that has a blade that must be moved manually a certain distance and then a spring inside the retractable blade knife will help the blade to move to be opened.

2. Description of the Prior Arts

A sliding blade knife has a blade and a handle and may be a retractable blade knife, switchblade knife or the like. The blade is retracted into the handle making the sliding knife popular since it can be safely and conveniently stored and carried for outdoor activities and work.

A conventional retractable blade knife, like utility knife, further comprises a locking mechanism. The blade is mounted in the handle. The locking mechanism is mounted between the handle and the blade. The blade must be pushed to be retracted or extended. The locking mechanism locks the blade in open and closed positions and prevents the blade from being retracted or extended accidentally. However, the blade of the conventional retractable blade knife must be moved manually to entirely open or entirely closed to activate the locking mechanism. Therefore, retracting or extending the blade is slow and inconvenient.

A conventional switchblade knife further comprises a spring mechanism and a release mechanism. The spring mechanism is mounted between the handle and the blade and ensures the blade is fully opened automatically when released from the release mechanism, generally very quickly. However, the switchblade knife is restricted by laws and is restricted to some people only in some countries. Therefore, the switchblade knife is not commonly used in ordinary people.

To overcome the shortcomings, the present invention provides a retractable blade knife with an opening assisted mechanism to mitigate or obviate the aforementioned problems.

SUMMARY OF THE INVENTION

The main objective of the present invention is to provide a retractable blade knife with an opening assisted mechanism that has a handle, a blade being mounted in the handle, an extending assembly being mounted between the blade and the handle. The blade has a spine edge and at least one detent formed at the spine edge. The extending assembly has a positioning frame, a slider being mounted beside the positioning frame and being attached to the blade and a spring being attached to the positioning frame and the slider. The positioning frame has a resilient rod selectively abutting the spine edge of the blade and the proximal end of the blade.

The blade should be pushed manually a certain distance to allow the spine edge of the blade to push a rear end of the resilient rod outwardly. When the detent of the blade and a lock protrusion of the slider both depart from the resilient rod of the positioning frame, the spring may further pull the slider to move together with the blade to stretch out the blade. Thus, the spring of the extending assembly helps the blade to be extended quickly with the spring and also prevents the blade from being retracted or extended accidentally with the resilient rod of the positioning frame abutting the blade. Therefore, the retractable blade knife with an opening assisted mechanism is used safely and conveniently.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
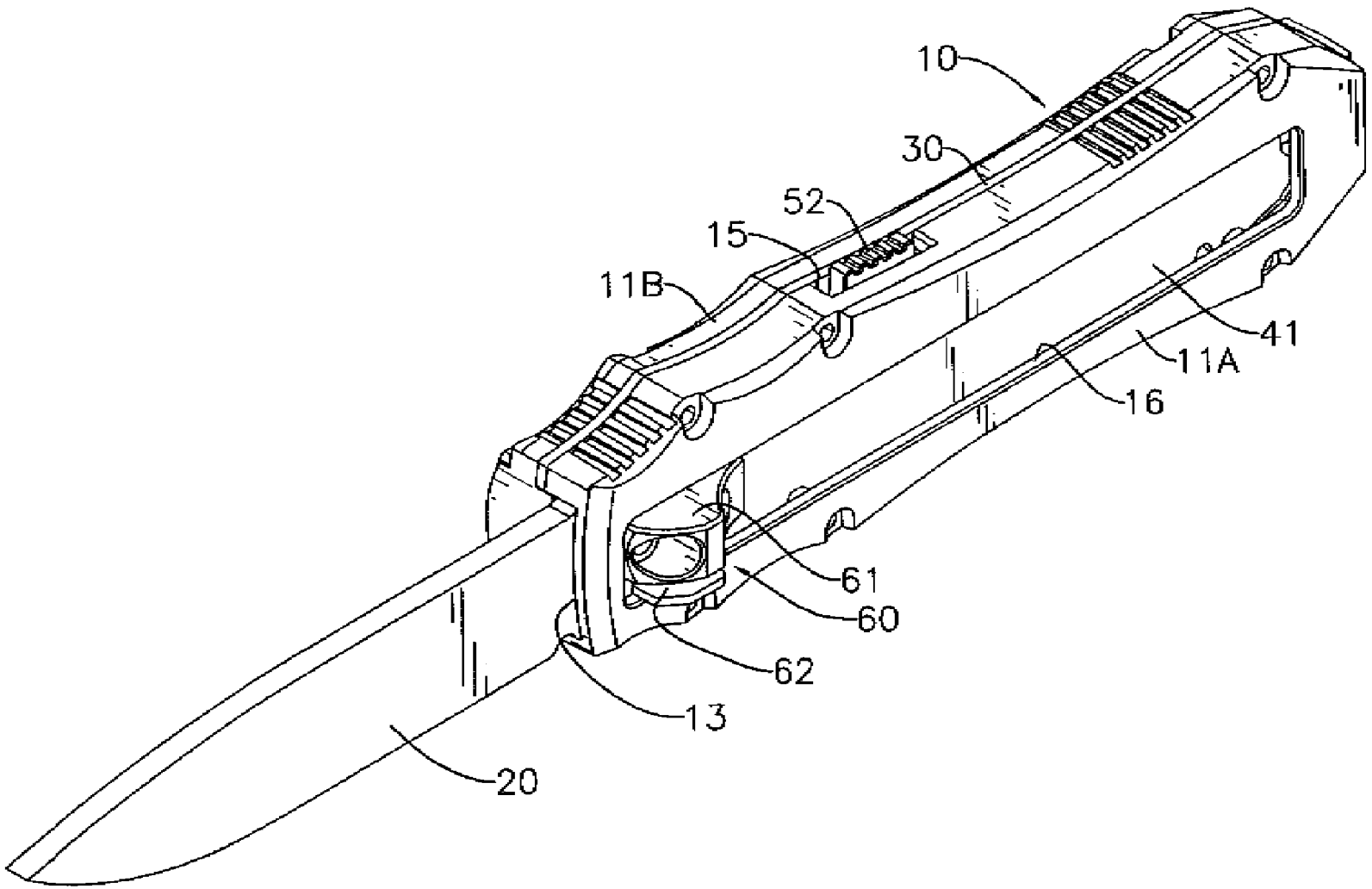
FIG. 1 is a perspective view of a retractable blade knife with an opening assisted mechanism in accordance with the present invention.
Figure 2:
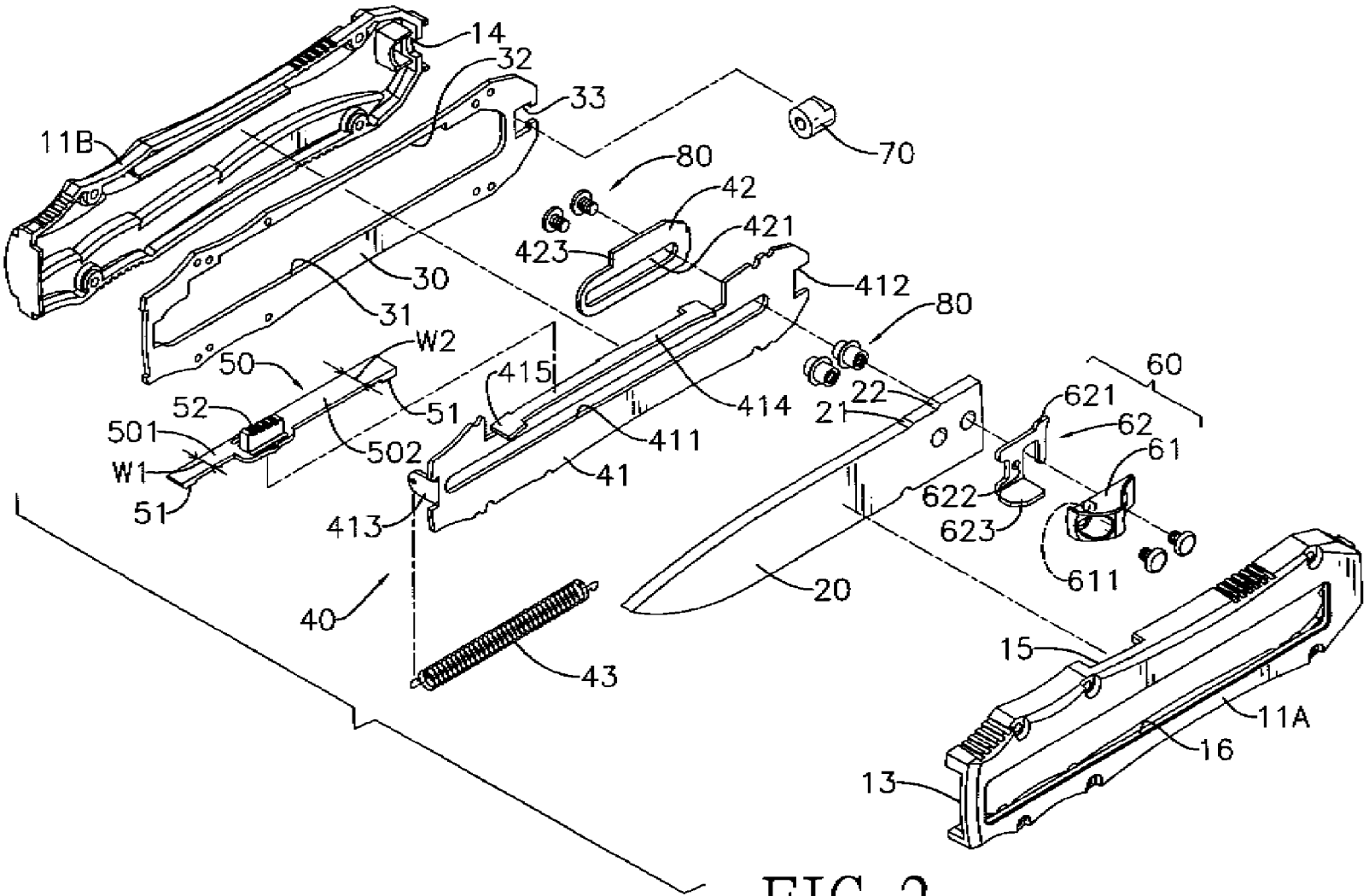
FIG. 2 is an exploded perspective view of the retractable blade knife in FIG. 1.

With reference to FIGS. 1 and 2 a retractable blade knife with an opening assisted mechanism in accordance with the present invention comprises a handle (10), a blade (20), an optional stationary frame (30), an extending assembly (40), an outer fastener (70), multiple inner fasteners (80), a safety bar (50) and an unlock assembly (60).

The handle (10) may be formed from two casings (11A, 11B) and has a front end, a rear end, a back surface, an open surface, a blade hole (13), a positioning hole (14), a guiding slot (15) and a sliding slot (16). The casings (11A, 11B) correspond to and are mounted to each other. Each casing (11A, 11B) has a front end, a rear end, a back surface and an open surface. The blade hole (13) is formed through the front end of the handle (10) and may be formed through the front end of one of the casings (11A). The positioning hole (14) is formed through the rear end of the handle (10) and may be formed through the rear ends of the casings (11A, 11B). The guiding slot (15) is formed through the back surface of the handle (10) and may be formed through the back surface of one of the casings (11A). The sliding slot (16) is formed through the open surface of the handle (10) and may be formed through the open surface of one casing (11A).

The blade (20) is mounted movably in the handle (10), may be mounted between the casings (11A, 11B) and has a proximal end, a spine edge, a closed surface, an open surface and at least one detent. The open surface of the blade (20) is visible through the sliding slot (16) of the handle (10). Each detent is formed on the spine edge of and near the proximal end of the blade (20), is sloping and may be a first step (21) and a second step (22).

The stationary frame (30) is mounted between the casings (11A, 11B) of the handle (10) to allow the casings (11A, 11B) to be mounted securely to one another through the stationary frame (30) and has a rear edge, an elongated hole (31), a rod recess (32) and a positioning recess (33). The elongated hole (31) is formed through the stationary frame (30), corresponds to the sliding slot (16) of the casing (11A) of the handle (10) and has a back edge. The rod recess (32) is formed in the back edge of the elongated hole (31) of the stationary frame (30). The positioning recess (33) is formed in the rear edge of the stationary frame (30) and corresponds to the positioning hole (14) of the handle (10).

Figure 3:
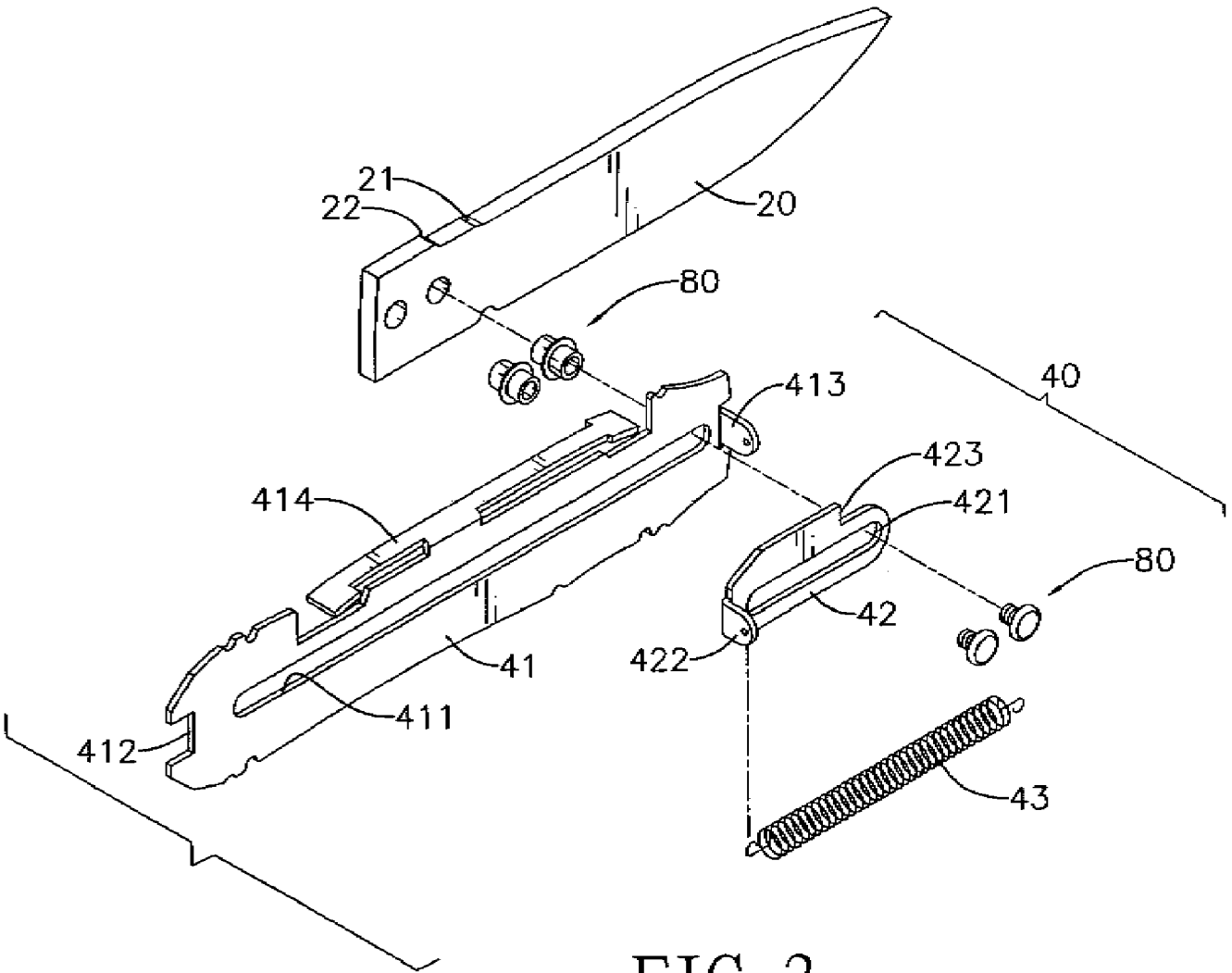
FIG. 3 is an enlarged, exploded perspective view of the retractable blade knife in FIG. 1.

With further reference to FIG. 3, the extending assembly (40) is mounted between the blade (20) and the handle (10) and has a positioning frame (41), a slider (42) and a spring (43).

The positioning frame (41) is mounted in the handle (10) beside the closed surface of the blade (20) and has an open surface, a closed surface, a rear edge, a front end, a back edge, a sliding slot (411), a positioning recess (412), a spring mount (413) and a resilient rod (414). The open surface faces the closed surface of the blade (20). The sliding slot (411) is formed through the positioning frame (41) and corresponds to the sliding slot (16) of the handle (10). The positioning recess (412) is formed in the rear edge of the positioning frame (41), corresponds to the positioning hole (14) of the handle (10) and the positioning recess (33) of the stationary frame (30). The spring mount (413) is formed on and protrudes transversely from the front end of the positioning frame (41) toward the closed surface of the positioning frame (41). The resilient rod (414) is mounted on the back edge of the positioning frame (41) and has a rear end and a front end. The rear end of the resilient rod (414) selectively abuts the spine edge of the blade (20). The front end of the resilient rod (414) selectively abuts the proximal end of the blade (20) and has a side edge and an abutting protrusion (415). The abutting protrusion (415) is formed on the side edge of the front end of the resilient rod (414).

Figure 5:
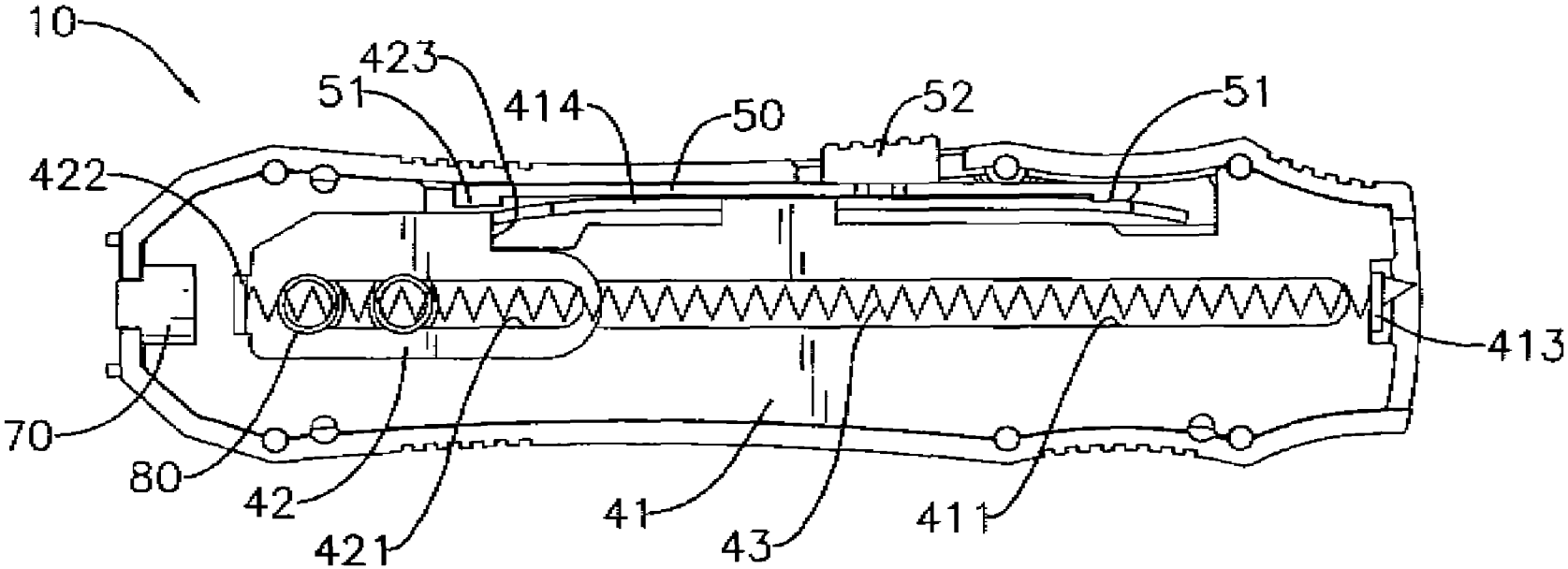
FIG. 5 is a closed side view of the retractable blade knife in FIG. 1, showing a locking mechanism.

With further reference to FIG. 5, the slider (42) is mounted beside and movably relative to the closed surface of the positioning frame (41), is attached to the closed surface of the blade (20), may be mounted movably in the elongated hole (31) of the stationary frame (30) and has a rear end, a back edge, a sliding slot (421), a spring mount (422) and a lock protrusion (423). The sliding slot (421) is formed through the slider (42) and corresponds to the sliding slot (411) of the positioning frame (41). The spring mount (422) is formed on and protrudes transversely from the rear end of the slider (42) and corresponds to the spring mount (413) of the positioning frame (41). The lock protrusion (423) is formed on the back edge of the slider (42) and selectively abuts the rear and of the resilient rod (414) of the positioning frame (41).

The spring (43) is connected respectively to the positioning frame (41) and the slider (42) and has two ends. The ends of the spring (43) are attached respectively to the positioning frame (41) and the slider (42) and may be attached respectively to the spring mounts (413, 422) of the positioning frame (41) and the slider (42).

The outer fastener (70) is mounted through the positioning hole (14) of the handle (10), is mounted securely in the positioning recesses (33, 142) of the stationary frame (30) and the positioning frame (41) to hold the stationary frame (30) and the positioning frame (41) firmly in the handle (10).

The inner fasteners (80) are mounted movably through the sliding slots (421, 411) of the slider (42) and the positioning frame (41) and are attached securely to the closed surface of the blade (20). Therefore, the blade (20) may move along the sliding slot (421) of the slider (42), and the blade (20) and the slider (42) may move along the sliding slot (411) of the positioning frame (41) together.

Figure 4:
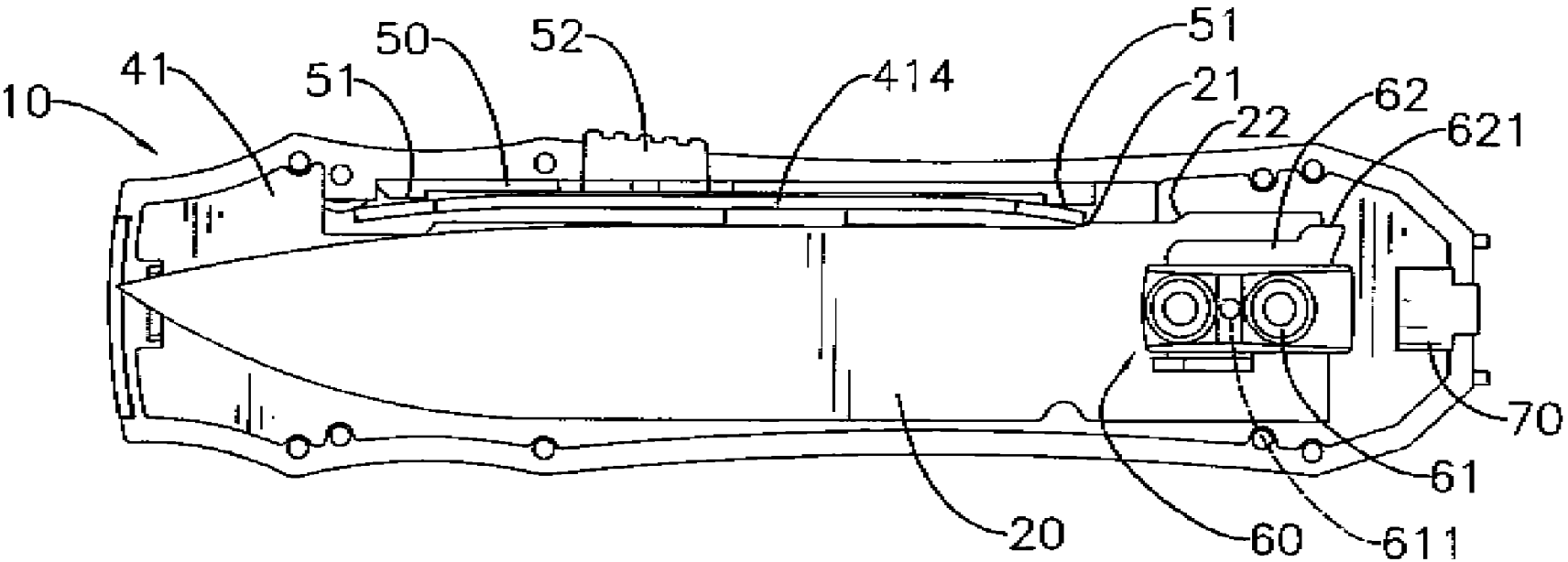
FIG. 4 is an open side view of the retractable blade knife in FIG. 1 with a blade shown retracted.

With further reference to FIG. 4, the safety bar (50) is mounted movably on the resilient rod (414) of the positioning frame (41), may be mounted movably in the rod recess (32) of the stationary frame (30) and has an inner surface, a back surface, two ends, a front part (501), a rear part (502), two inner protrusions (51) and a back protrusion (52). The inner protrusions (51) are formed respectively at the two ends of the inner surface of the safety bar (50) and alternately and respectively correspond to the rear end and the front end of the resilient rod (414) of the positioning frame (41). The back protrusion (52) is formed on the back surface of the safety bar (50) and protrudes out of the guiding slot (15) of the handle (10) to allow the safety bar (50) to be moved easily. The front part (501) of the safety bar (50) is formed between the back protrusion (52) of the safety bar (50) and one end of the safety bar (50) and has a width (w1). The rear part (502) of the safety bar (50) is formed between the back protrusion (52) of the safety bar (50) and the other end of the safety bar (50) and has a width (w2). The width (w2) of the rear part (502) of the safety bar (50) is wider than the width (w1) of the front part (502) of the safety bar (50).

Figure 11:
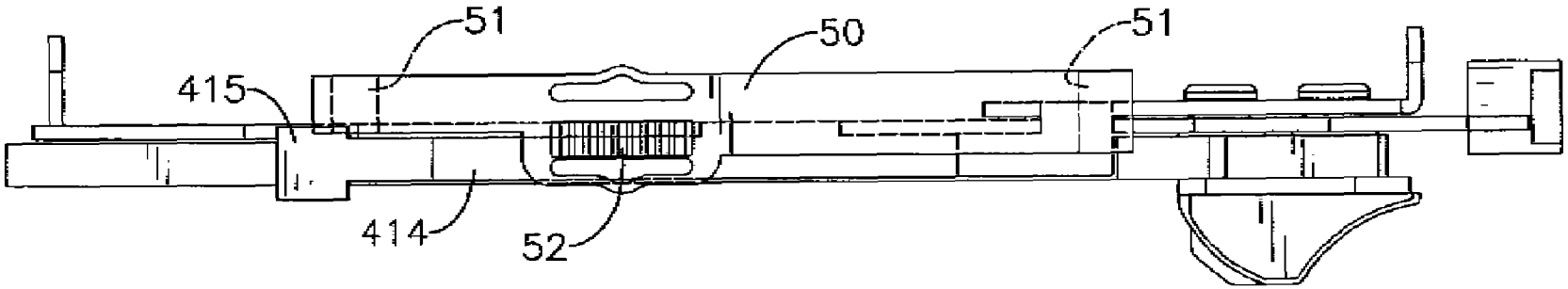
FIG. 11 is a partially top view of the retractable blade knife in FIG. 1, showing a resilient rod being locked.
Figure 12:
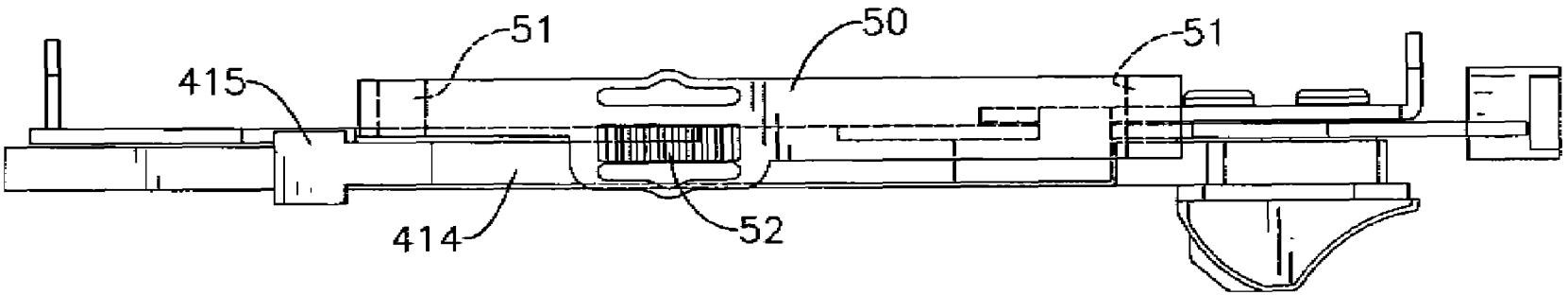
FIG. 12 is a partially top view of the retractable blade knife in FIG. 1, showing a resilient rod being unlocked.

Therefore, with further reference to FIGS. 11 and 12, when the safety bar (50) is moved to be disposed at the front end of the handle (10), the inner protrusions (51) of the safety bar (50) respectively abut and bends the corresponding abutting protrusion (415) and rear end of the resilient rod (414). Therefore, the resilient rod (414) is locked. When the safety bar (50) is moved to be disposed at the rear end of the handle (10), the inner protrusions (51) of the safety bar (50) respectively depart from the corresponding abutting protrusion (415) and rear end of the resilient rod (414). Therefore, the resilient rod (414) is unlocked.

The unlock assembly (60) is mounted on the open surface of the blade (20) near the proximal end, protrudes out of the sliding slot (16) of the handle (10) and has a thumb stud (61) and an unlock bracket (62).

The thumb stud (61) is attached to the open surface of the blade (20) and protrudes out of the sliding slot (16) of the handle (10) and has a closed surface, a belly surface and a pivot protrusion (611). The closed surface of the thumb stud (61) faces the open surface of the blade (20). The pivot protrusion (611) is formed on the closed surface of the thumb stud (61). When the thumb stud (61) is pushed to move along the sliding slot (16) of the handle (10), the blade (20) and the slider (42) may move along the sliding slot (411) of the positioning frame (41) simultaneously.

The unlock bracket (62) is mounted between the open surface of the blade (20) and the thumb stud (61), is mounted pivotally on the thumb stud (61) and has a sliding wall, a limiting wall (623), a pivot hole (622) and an unlock protrusion (621). The sliding wall of the unlock bracket (62) is disposed slidably on the blade (20) and has a back edge. The limiting wall (623) of the unlock bracket (62) is formed transversely on the sliding wall of the unlock bracket (62) and corresponds to and is selectively pushed by the belly surface of the thumb stud (61). The pivot hole (622) is formed through the sliding wall of the unlock bracket (62) and is mounted around the pivot protrusion (611) of the thumb stud (61) to allow the unlock bracket (62) to pivot relative to the thumb stud (61). The unlock protrusion (621) is formed on the back edge of the sliding wall of the unlock bracket (62) and selectively abuts the resilient rod (414) of the positioning frame (41).

With reference to FIGS. 2, 4 and 11, the blade (20) is retracted securely in the handle (10). The spring (43) is stretched, the safety bar (50) is disposed at the front end of the handle (10) to lock the resilient rod (414). Therefore, the rear end of the resilient rod (414) abuts the first step (21) of the spine edge of the blade (20) to prevent the blade (20) from being extended accidentally.

Figure 6:
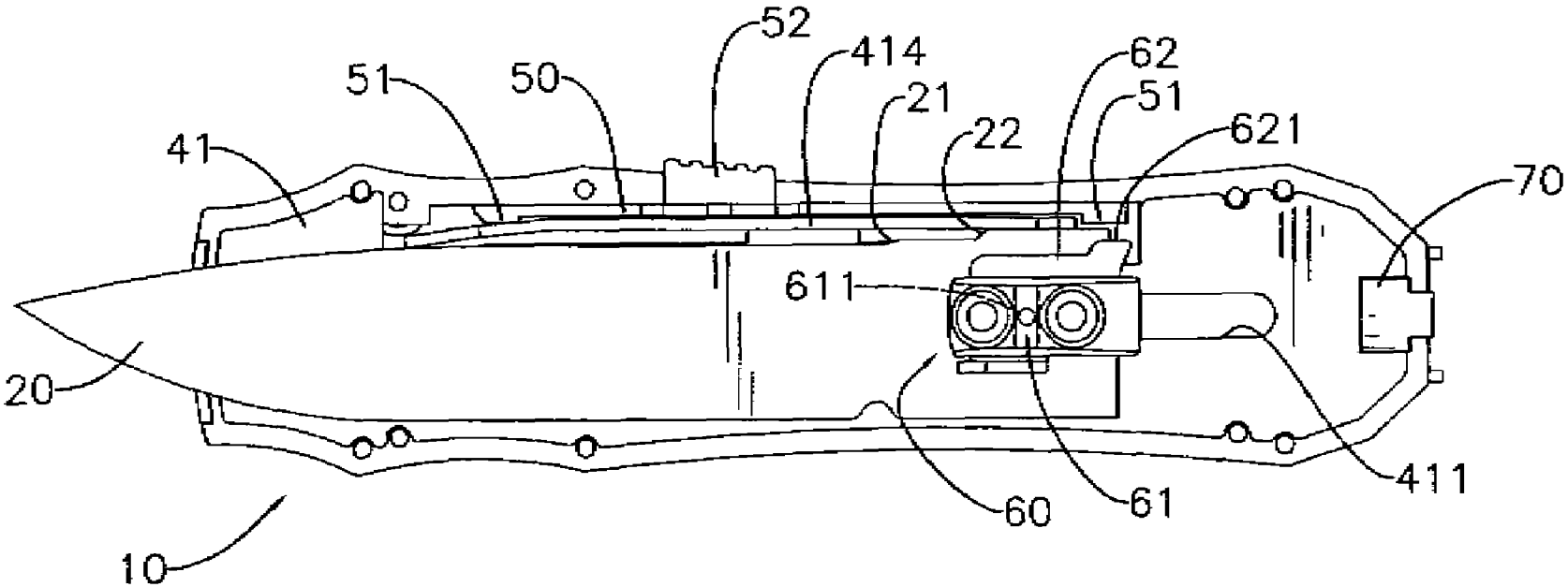
FIG. 6 is an operational open side view of the retractable blade knife in FIG. 1, the blade shown partially extended.
Figure 7:
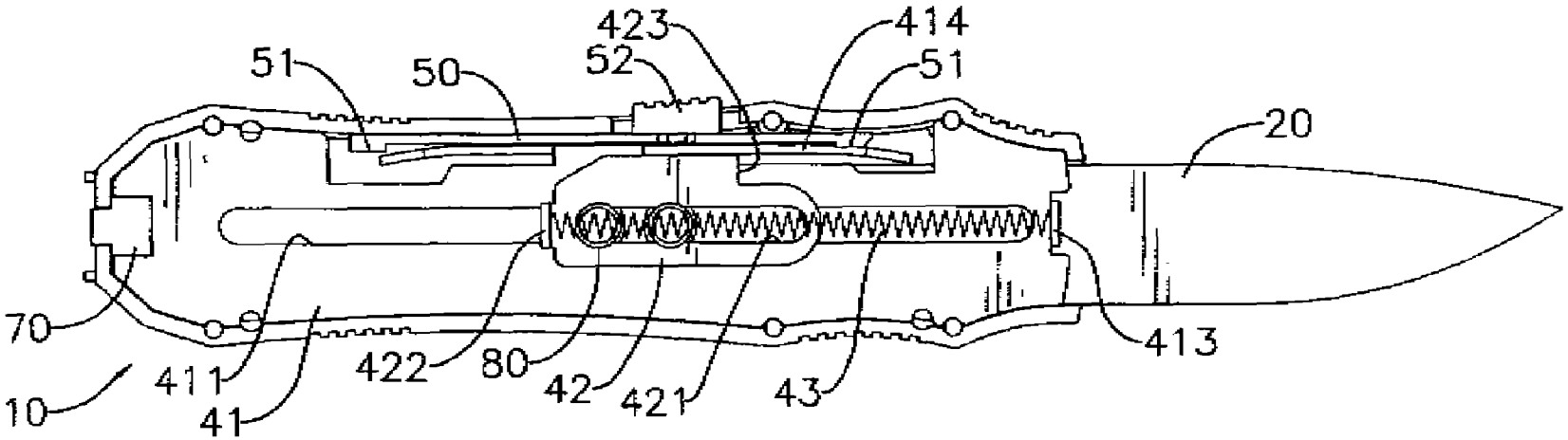
FIG. 7 is an operational closed side view of the retractable blade knife in FIG. 1, the blade shown partially extended.

With further reference to FIGS. 5, 6 and 7, the safety bar (50) is moved to be disposed at the rear end of the handle (10) to unlock the resilient rod (414). The thumb stud (61) along with the blade (20) should be pushed to move along the sliding slots (411, 421) of the positioning frame (41) and the slider (42) and to allow the spine edge of the blade (20) to move relative to the rear end of the resilient rod (414). The sloping first step (21) of blade (20) pushes the rear end of the resilient rod (414) outwardly gradually. When the second step (22) of the blade (20) abuts the rear end of the resilient rod (414), the thumb stud (61) and the blade (20) should be moved with a greater force. Therefore, the second step (22) of the blade (20) further pushes the rear end of the resilient rod (414) outwardly to allow the rear end of the resilient rod (414) and the lock protrusion (423) of the slider (42) to depart from and may pass through the rear end of the resilient rod (414). Consequently, the spring (43) may pull the slider (42) to move along with the blade (20) to stretch out the blade (20). Therefore, the retractable blade knife is assisted and become extended.

Figure 8:
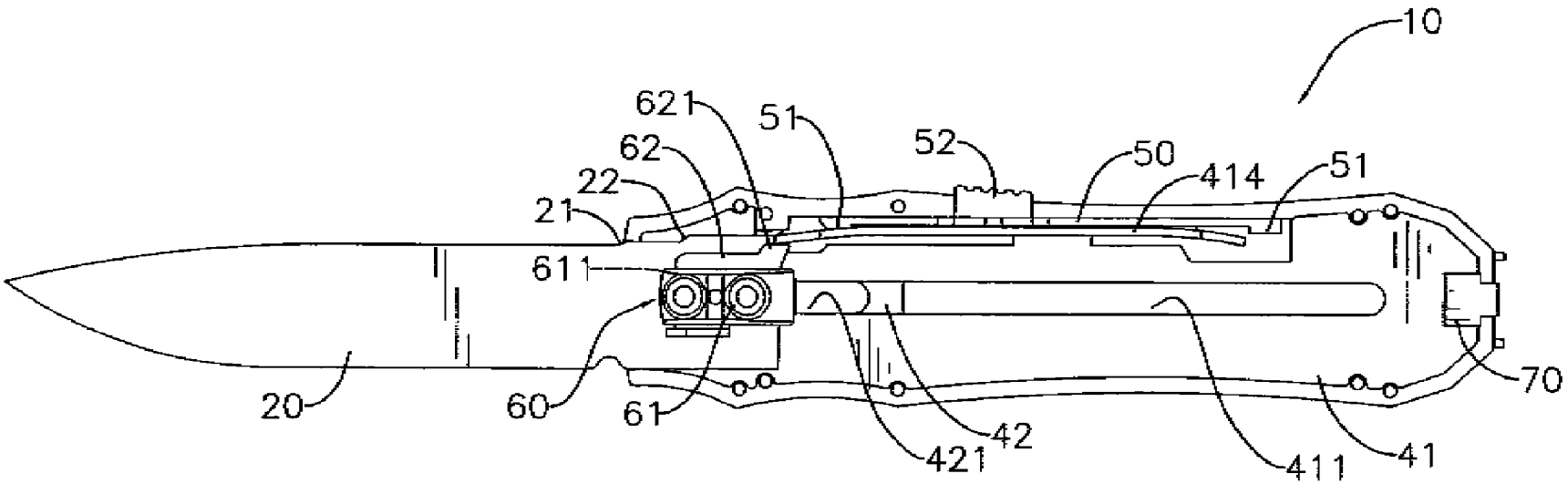
FIG. 8 is an open side view of the retractable blade knife in FIG. 1, the blade shown being extended.
Figure 9:
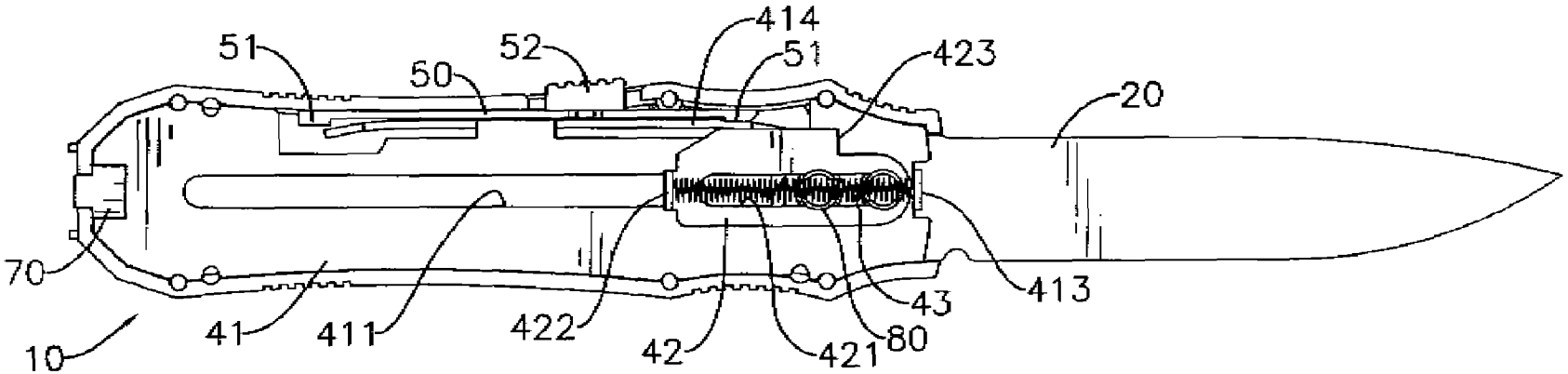
FIG. 9 is a closed side view of the retractable blade knife in FIG. 1, the blade shown being extended.

With further reference to FIGS. 8 and 9, after the blade (20) is stretched out, the safety bar (50) should move to be disposed at the front end of the handle (10) to lock the resilient rod (414). Therefore, the front end of the resilient rod (414) abuts the proximal end of the blade (20) and the blade (20) would not be retracted while being pushed so can be used safely.

Figure 10:
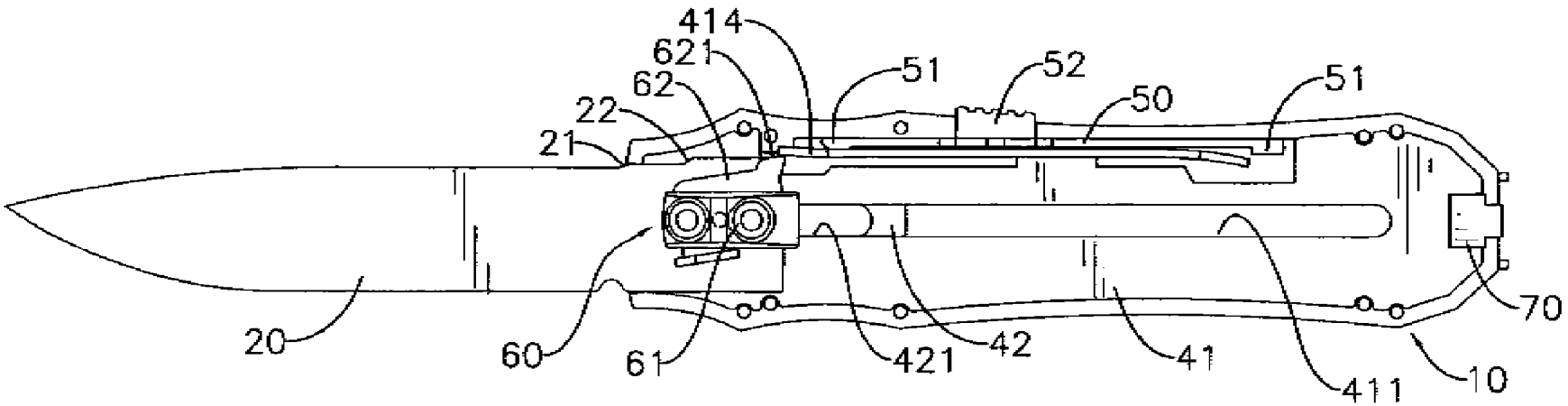
FIG. 10 is an open side view of the retractable blade knife in FIG. 1, an unlock protrusion of an unlock assembly abutting a front end of a resilient rod.

With further reference to FIG. 10, when the safety bar (50) is moved to be disposed at the rear end of the handle (10) to unlock the resilient rod (414) and the limiting wall (623) of the unlock bracket (62) of the unlock assembly (60) is pushed, the unlock bracket (62) is pivoted. Therefore, the unlock protrusion (621) of the unlock bracket (62) lifts the front end of the resilient rod (414) to allow the front end of the resilient rod (414) to depart from the proximal end of the blade (20). Consequently, the blade (20) can be retracted into the handle (10) by pushing the thumb stud (61).

The retractable blade knife with an opening assisted mechanism as described has the following advantages. The blade (20) must be moved manually a certain distance to allow the sloping detents of the blade (20) to push the rear end of the resilient rod (414) outwardly gradually. Until the detents of the blade (20) and the lock protrusion (423) of the slider (42) both depart from and may pass through the rear end of resilient rod (414), the spring (43) of the extending assembly (40) serves to complete movement of the blade (20) without application of further outside forces. Thus, the extending assembly (40) helps the blade (20) to be extended quickly with the spring (43) and also prevents the blade (20) from being retracted and extended accidentally with the resilient rod (414) of the positioning frame (41) abutting the blade (20). Therefore, the retractable blade knife with an opening assisted mechanism is used safely and conveniently.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A retractable blade knife comprising
- a handle having
  - a front end;
  - a rear end;
  - a back surface;
  - an open surface;
  - a blade hole being formed through the front end of the handle; and
  - a sliding slot being formed through the open surface of the handle;
- a blade being mounted movably in the handle and having
  - a proximal end;
  - a spine edge;
  - a closed surface;
  - an open surface being visible through the sliding slot of the handle; and
  - at least one detent being formed on the spine edge of and near the proximal end of the blade and being sloping;
- an extending assembly being mounted between the blade and the handle and having
  - a positioning frame being mounted in the handle beside the closed surface of the blade and having
    - an open surface facing the closed surface of the blade;
    - a closed surface;
    - a rear edge;
    - a front end;
    - a back edge;
    - a sliding slot being formed through the positioning frame and corresponding to the sliding slot of the handle; and
    - a resilient rod being mounted on the back edge of the positioning frame and having
      - a rear end selectively abutting the spine edge of the blade; and
      - a front end selectively abutting the proximal end of the blade;
  - a slider being mounted beside and movably relative to the closed surface of the positioning frame, being attached to the closed surface of the blade and having
    - a rear end;
    - a back edge; and
    - a lock protrusion being formed on the back edge of the slider and selectively abutting the rear end of the resilient rod of the positioning frame; and
  - a spring being connected respectively to the positioning frame and the slider and having two ends being attached respectively to the positioning frame and the slider; and
- an unlock assembly being mounted on the open surface of the blade near the proximal end and protruding out of the sliding slot of the handle.

2. The retractable blade knife as claimed in claim 1, wherein
- the handle further has a guiding slot being formed through the back surface of the handle;
- the front end of the resilient rod of the positioning frame further has
  - a side edge; and
  - a abutting protrusion being formed on the side edge of the front end of the resilient rod; and
- the retractable blade knife further comprises a safety bar being mounted movably on the resilient rod of the positioning frame and having an inner surface;

a back surface;

two ends; two inner protrusions being formed respectively at the two ends of the inner surface of the safety bar and alternately and respectively corresponding to the rear end and the front end of the resilient rod of the positioning frame;

a back protrusion being formed on the back surface of the safety bar and protruding out of the guiding slot of the handle;

a front part being formed between the back protrusion of the safety bar and one end of the safety bar and having a width; and a rear part being formed between the back protrusion of the safety bar and the other end of the safety bar and having a width being wider than the width of the front part of the safety bar.

3. The retractable blade knife as claimed in claim 1, wherein the positioning frame of the extending assembly further has a spring mount being formed on and protruding transversely from the front end of the positioning frame toward the closed surface of the positioning frame;

the slider of the extending assembly further has a spring mount being formed on and protruding transversely from the rear end of the slider and corresponding to the spring mount of the positioning frame; and the ends of the spring of the extending assembly are attached respectively to the spring mounts of the positioning frame and the slider.

4. The retractable blade knife as claimed in claim 2, wherein the positioning frame of the extending assembly further has a spring mount being formed on and protruding transversely from the front end of the positioning frame toward the closed surface of the positioning frame;

the slider of the extending assembly further has a spring mount being formed on and protruding transversely from the rear end of the slider and corresponding to the spring mount of the positioning frame; and the ends of the spring of the extending assembly are attached respectively to the spring mounts of the positioning frame and the slider.

5. The retractable blade knife as claimed in claim 1, wherein the unlock assembly further has a thumb stud being attached to the open surface of the blade and protruding out of the sliding slot of the handle and having a closed surface facing the open surface of the blade;

a belly surface; and a pivot protrusion being formed on the closed surface of the thumb stud; and an unlock bracket being mounted between the open surface of the blade and the thumb stud, being mounted pivotally on the thumb stud and having a sliding wall being disposed slidably on the blade and having a back edge;

a limiting wall being formed transversely on the sliding wall of the unlock bracket and corresponding to and being selectively pushed by the belly surface of the thumb stud;

a pivot hole being formed through the sliding wall of the unlock bracket and being mounted around the pivot protrusion of the thumb stud; and an unlock protrusion being formed on the back edge of the sliding wall of the unlock bracket and selectively abutting the resilient rod of the positioning frame.

6. The retractable blade knife as claimed in claim 2, wherein the unlock assembly further has a thumb stud being attached to the open surface of the blade and protruding out of the sliding slot of the handle and having a closed surface facing the open surface of the blade;

a belly surface; and a pivot protrusion being formed on the closed surface of the thumb stud; and an unlock bracket being mounted between the outer surface of the blade and the thumb stud, being mounted pivotally on the thumb stud and having a sliding wall being disposed slidably on the blade and having a back edge;

a limiting wall being formed transversely on the sliding wall of the unlock bracket and corresponding to and being selectively pushed by the belly surface of the thumb stud;

a pivot hole being formed through the sliding wall of the unlock bracket and being mounted around the pivot protrusion of the thumb stud; and an unlock protrusion being formed on the back edge of the sliding wall of the unlock bracket and selectively abutting the resilient rod of the positioning frame.

7. The retractable blade knife as claimed in claim 3, wherein the unlock assembly further has a thumb stud being attached to the open surface of the blade and protruding out of the sliding slot of the handle and having a closed surface facing the open surface of the blade;

a belly surface; and a pivot protrusion being formed on the closed surface of the thumb stud; and an unlock bracket being mounted between the outer surface of the blade and the thumb stud, being mounted pivotally on the thumb stud and having a sliding wall being disposed slidably on the blade and having a back edge;

a limiting wall being formed transversely on the sliding wall of the unlock bracket and corresponding to and being selectively pushed by the belly surface of the thumb stud;

a pivot hole being formed through the sliding wall of the unlock bracket and being mounted around the pivot protrusion of the thumb stud; and an unlock protrusion being formed on the back edge of the sliding wall of the unlock bracket and selectively abutting the resilient rod of the positioning frame.

8. The retractable blade knife as claimed in claim 4, wherein the unlock assembly further has a thumb stud being attached to the open surface of the blade and protruding out of the sliding slot of the handle and having a closed surface facing the open surface of the blade;

a belly surface; and a pivot protrusion being formed on the closed surface of the thumb stud; and an unlock bracket being mounted between the outer surface of the blade and the thumb stud, being mounted pivotally on the thumb stud and having a sliding wall being disposed slidably on the blade and having a back edge;

a limiting wall being formed transversely on the sliding wall of the unlock bracket and corresponding to and being selectively pushed by the belly surface of the thumb stud;

a pivot hole being formed through the sliding wall of the unlock bracket and being mounted around the pivot protrusion of the thumb stud; and an unlock protrusion being formed on the back edge of the sliding wall of the unlock bracket and selectively abutting the resilient rod of the positioning frame.

9. The retractable blade knife as claimed in claim 5, wherein the slider further has a sliding slot being formed through the slider and corresponding to the sliding slot of the positioning frame; and the retractable blade knife further comprises multiple inner fasteners being mounted movably through the sliding slots of the slider and the positioning frame and being attached securely to the closed surface of the blade.

10. The retractable blade knife as claimed in claim 6, wherein the slider further has a sliding slot being formed through the slider and corresponding to the sliding slot of the positioning frame; and the retractable blade knife further comprises multiple inner fasteners being mounted movably through the sliding slots of the slider and the positioning frame and being attached securely to the closed surface of the blade.

11. The retractable blade knife as claimed in claim 7, wherein the slider further has a sliding slot being formed through the slider and corresponding to the sliding slot of the positioning frame; and the retractable blade knife further comprises multiple inner fasteners being mounted movably through the sliding slots of the slider and the positioning frame and being attached securely to the closed surface of the blade.

12. The retractable blade knife as claimed in claim 8, wherein the slider further has a sliding slot being formed through the slider and corresponding to the sliding slot of the positioning frame; and the retractable blade knife further comprises multiple inner fasteners being mounted movably through the sliding slots of the slider and the positioning frame and being attached securely to the closed surface of the blade.

13. The retractable blade knife as claimed in claim 1, wherein the handle is formed from two casings corresponding to and being mounted to each other and each casing has a front end;

a rear end;

a back surface; and an open surface;

the blade hole of the handle is formed through the front end of one of the casings;

the guiding slot of the handle is formed through the back surface of one of the casings;

the sliding slot of the handle is formed through the open surface of one of the casings;

the blade is mounted between the casings;

the retractable blade knife further comprises a stationary frame being mounted between the casings of the handle and having a rear edge;

an elongated hole being formed through the stationary frame, corresponding to the sliding slot of the handle and having a back edge; and the slider of the extending assembly is mounted movably in the elongated hole of the stationary frame.

14. The retractable blade knife as claimed in claim 13, wherein the handle further has a positioning hole is formed through the rear ends of the casings of the handle;

the stationary frame further has a positioning recess being formed in the rear edge of the stationary frame and corresponding to the positioning hole of the handle;

the positioning frame has a positioning recess being formed in the rear edge of the positioning frame, corresponding to the positioning hole of the handle and the positioning recess of the stationary frame; and the retractable blade knife further comprises an outer fastener being mounted through the positioning hole of the handle and being mounted securely in the positioning recesses of the stationary frame and the positioning frame.

15. The retractable blade knife as claimed in claim 13, wherein the stationary frame further has a rod recess being formed in the back edge of the elongated hole of the stationary frame; and the safety bar is mounted movably in the rod recess of the stationary frame.

16. The retractable blade knife as claimed in claim 1, wherein the blade has multiple detents being a first step and a second step.

* * * * *